United States Patent [19]

Richard

[11] Patent Number: 4,589,157

[45] Date of Patent: May 20, 1986

[54] APPARATUS FOR THE CONSTRUCTION OF A BRIDGE FLOOR AND SIMILAR STRUCTURES, AND CONSTRUCTIONS WHICH ARE OBTAINED

[75] Inventor: Pierre Richard, Neuilly S. Seine, France

[73] Assignee: Bouygues, Clamart, France

[21] Appl. No.: 698,267

[22] Filed: Feb. 5, 1985

Related U.S. Application Data

[63] Continuation of Ser. No. 460,596, Jan. 24, 1983, abandoned.

[30] Foreign Application Priority Data

Jan. 24, 1983 [FR] France ..... 8201439

[51] Int. Cl.[4] ..... E01D 9/04; E01D 19/12

[52] U.S. Cl. ..... 14/73; 14/6; 14/14; 52/228

[58] Field of Search ..... 14/2, 3, 6, 14, 24, 14/25, 26, 73; 52/225, 226, 227, 228, 648, 650, 693

[56] References Cited

U.S. PATENT DOCUMENTS

| | | | |
|---|---|---|---|
| 87,174 | 2/1869 | Kellogg | 14/14 |
| 2,155,121 | 4/1939 | Finsterwalder | 52/225 X |
| 2,353,039 | 7/1944 | Janiszewski | 14/14 X |
| 3,103,025 | 9/1963 | Gassner et al. | 14/73 X |
| 3,152,671 | 10/1964 | Mallory, Jr. | 52/650 |
| 3,587,125 | 6/1971 | McLeese | 14/6 |
| 3,601,939 | 8/1971 | Clyne | 52/227 X |
| 3,918,222 | 11/1975 | Bahramian | 52/227 |
| 4,070,847 | 7/1978 | Madl, Jr. | 52/650 |
| 4,144,686 | 3/1979 | Gold | 52/225 |
| 4,211,044 | 7/1980 | Gugliotta et al. | 52/650 X |
| 4,221,330 | 9/1980 | Schlaeger | 52/227 X |
| 4,282,619 | 8/1981 | Rooney | 14/6 |
| 4,324,037 | 4/1982 | Grady, II | 52/227 X |

FOREIGN PATENT DOCUMENTS

| | | | |
|---|---|---|---|
| 2442309 | 7/1980 | France | 52/648 |

*Primary Examiner*—James A. Leppink
*Assistant Examiner*—Matthew Smith
*Attorney, Agent, or Firm*—McCormick, Paulding & Huber

[57] ABSTRACT

This invention relates to a production of a structure by means of arch stones. The arch stones comprise series of mixed steel-concrete arch stones ($V_M$), each comprising a metal frame of steel integral with an upper concrete slab, these series being separated by interposed concrete arch stones or sections, ($V_B$), the assembly of the arch stones being reinforced longitudinally by prestress cables which penetrate the metal frames and are attached at their ends to the concrete arch stones. This invention may be applied to bridge floors and similar structures.

13 Claims, 8 Drawing Figures

APPARATUS FOR THE CONSTRUCTION OF A BRIDGE FLOOR AND SIMILAR STRUCTURES, AND CONSTRUCTIONS WHICH ARE OBTAINED

This application is a continuation of Ser. No. 460,596 filed on Jan. 24, 1983 now abandoned.

BACKGROUND OF THE INVENTION

This invention relates to the floor of a bridge or a similar structure, to floor arch stones and to a method of constructing a bay of a bridge comprising a floor of this type.

The expression "floor or a bridge or a similar structure" designates any structure which spans a certain range and is only supported at certain points, like a bridge floor, a flooring or a building cover.

BRIEF SUMMARY OF THE INVENTION

According to the present invention, the bridge floor or similar structure is characterised in that it is constructed from arch stones or sections which are assembled step by step, these arch stones or sections comprising series of mixed steel-concrete arch stones or sections, each comprising a metal frame of steel integral with an upper concrete slab, said series of mixed arch stones or sections being separated by interposed concrete arch stones or sections, the assembly of the arch stones or sections being reinforced by prestress cables which penetrate the metal frames and are attached at their ends to the concrete arch stones.

The term "arch stone" designates a repetitive transverse section of the floor, this section extending on the one hand over the complete width of the floor and, on the other hand, over only a fraction of the length of the floor. Consequently, the expressions "longitudinal" and "transverse" will be used with reference to the floor, i.e. "longitudinal" will designate a line or plate which extends in the length of the floor and "transverse" will designate a line or plane which extends in the width of the floor.

The present invention also relates to a preferred mixed arch stone for constructing the floor, this arch stone comprising an upper concrete slab supported by a metal frame, the metal frame comprising prefabricated connection pieces distributed in an area ruled by the intersections of longitudinal lines, transverse lines and diagonal lines, the longitudinal lines and the transverse lines being located in said adjusted area and the diagonal lines connecting this area to the upper concrete slab, the metal frame comprising sections positioned along said lines and welded together and/or to said connection pieces.

One example of an arch stone and of a floor according to the present invention will now be described in the following with reference to the figures of the accompanying drawings, some of which are essentially diagrams, whereas others are detail views, the views being restricted to what is necessary for a man skilled in the art to understand this invention.

DETAILED DESCRIPTION

Figure 1:
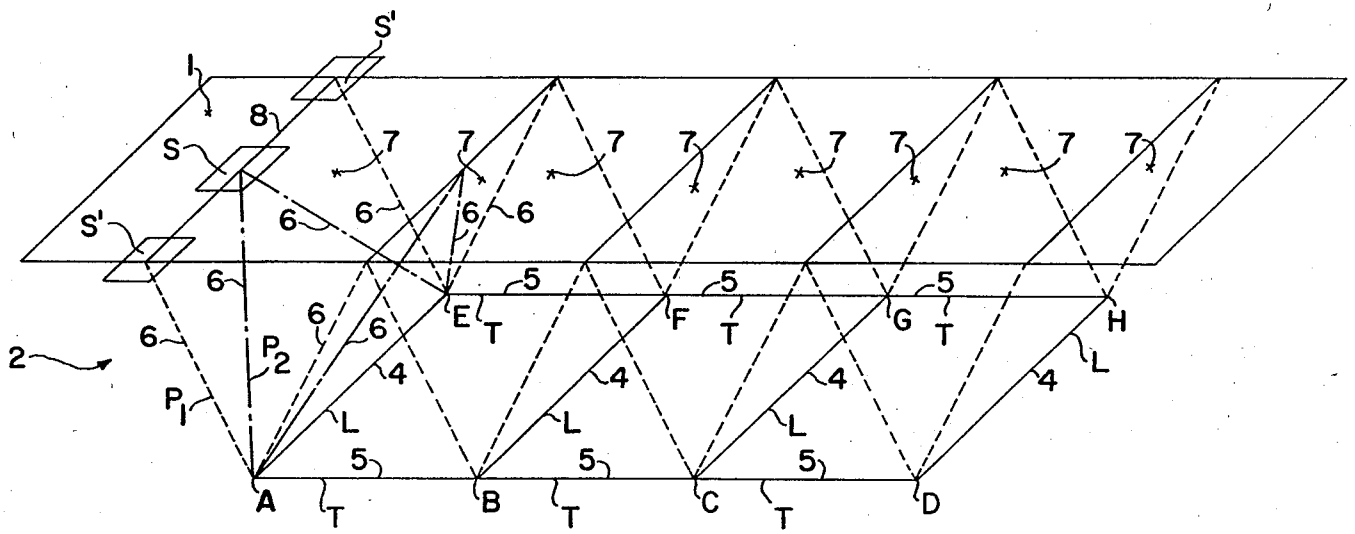
FIG. 1 is a schematic perspective of an arch stone.

A standard example of a mixed arch stone according to the present invention is schematically illustrated in FIG. 1.

This arch stone comprises an upper concrete table 1 supported by a three-dimensional metal frame 2. The metal frame is contructed from sections and connection pieces.

The sections are positioned, on the the one hand, in a virtual ruled area 3 along longitudinal lines 4 and transverse lines 5 and, on the other hand, along diagonal lines 6 connecting the lower area 3 to the upper table 1. The sections positioned along the diagonal lines or "oblique" sections are located in virtual planes 7 which are alternately inclined towards the left-hand side and towards the right-hand side. The sections have not been illustrated in FIG. 1 for reasons of clarity, but only the lines along which they are arranged are shown. Moreover, only the diagonal lines or oblique sections 6 of the first plane 7 inclined towards the left-hand side and of the first plane 7 inclined toward the right-hand side of the left-hand end of the arch stone have been shown, but it will be understood that the other inclined planes contain similar oblique sections. The lines 8 do not have a particular significance and have only been illustrated to clarify the drawing.

The frame of the arch stone comprises eight connection pieces A to H, simplified by dots in FIG. 1. Each connection piece is a node where a longitudinal section or frame member L, one or two transverse sections or frame members T, two oblique sections or frame members $P_1$, $P_2$ inclined towards the left-hand side and two oblique sections or frame members $P_1$, $P_2$ inclined towards the right hand side meet and are assembled.

The connection pieces are located in the ruled area 3.

Figure 2:
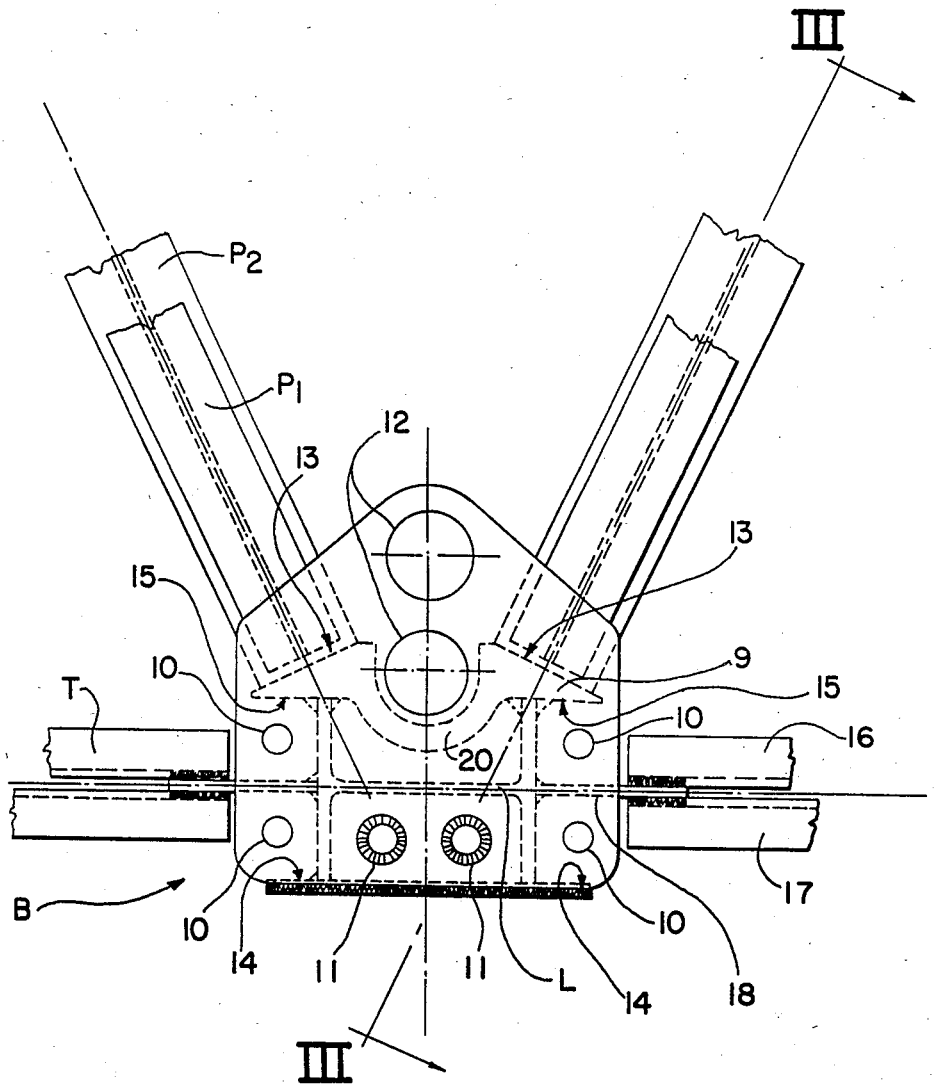
FIG. 2 is a front view of a connection piece of the metal frame of a mixed arch stone according to this invention, the plane of view being a transverse vertical plane.
Figure 3:
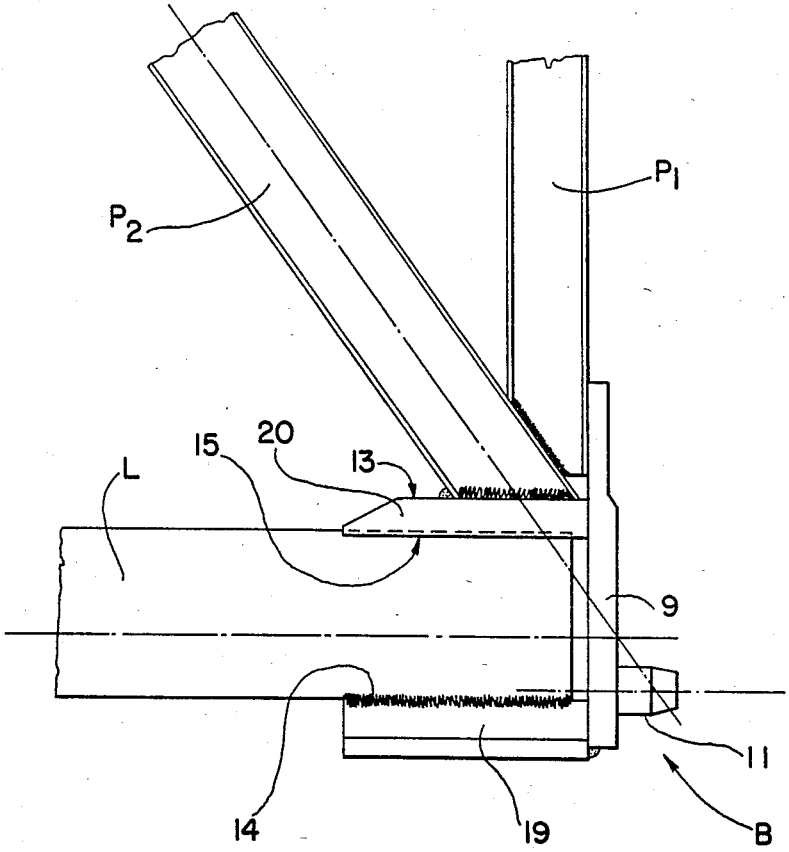
FIG. 3 is a section of the connecting piece according to the plane III—III of FIG. 2.

One connection piece has been illustrated in detail in FIGS. 2 and 3. This is for example piece B.

The connection piece comprises a front plate 9 to be fitted against a plate or a corresponding surface of the adjacent arch stone and which is provided with holes 10 for the passage of bolts for attaching the two arch stones, and/or means 11 for the relative positioning of the two arch stones and/or holes 12 for the free passage of prestress cables. The positioning means 11 preferably comprise pin/bore couplings, the pin of one plate penetrating the bore of the adjacent plate and absorbing the shearing stresses. The connection piece has, behind the front plate 9, inclined surfaces 13, against which the ends of some of the oblique sections come to abut perpendicularly and are welded.

In fact, the oblique sections comprise, on the one hand, sections $P_1$ positioned obliquely in a vertical plane (which is the plane of the front surface or of the rear surface of the arch stone) and, on the other hand, sections $P_2$ directed obliquely towards regions such as S (FIG. 1) substantially situated in the middle of the under-face of the upper slab.

The oblique sections $P_2$ are welded to the surfaces 13, whereas the oblique sections $P_1$ are welded to the plates 9 and to the oblique sections $P_2$ (FIG. 3).

The connection piece has horizontal surfaces 14, 15, between which the ends of the sections L are positioned, arranged along the longitudinal lines, and to which these ends are welded.

In the illustrated example, the sections L arranged along the longitudinal lines are H-shaped sections and the sections T arranged along the transverse lines are welded to the flanges of the H-shaped sections in the region of the connection pieces. More precisely, the sections T arranged along the transverse lines are formed by two angle irons 16, 17 welded to a flat part 18 positioned between the angle irons and itself welded to the H-shaped section (FIG. 2).

The connection pieces are preferably cast parts, at least some of which comprise a vertical front plate 9 and, on the back of this wall, a lower horizontal plate 19 and an upper horizontal plate 20 which has two cuneiform wings (FIGS. 2 and 3).

According to one characteristic of the present invention, each oblique section is attached to the concrete slab by a device which allows the section to be disconnected from the slab at will. This device will be described in the following with reference to the oblique sections $P_1$ of the transverse vertical planes.

Figure 4:
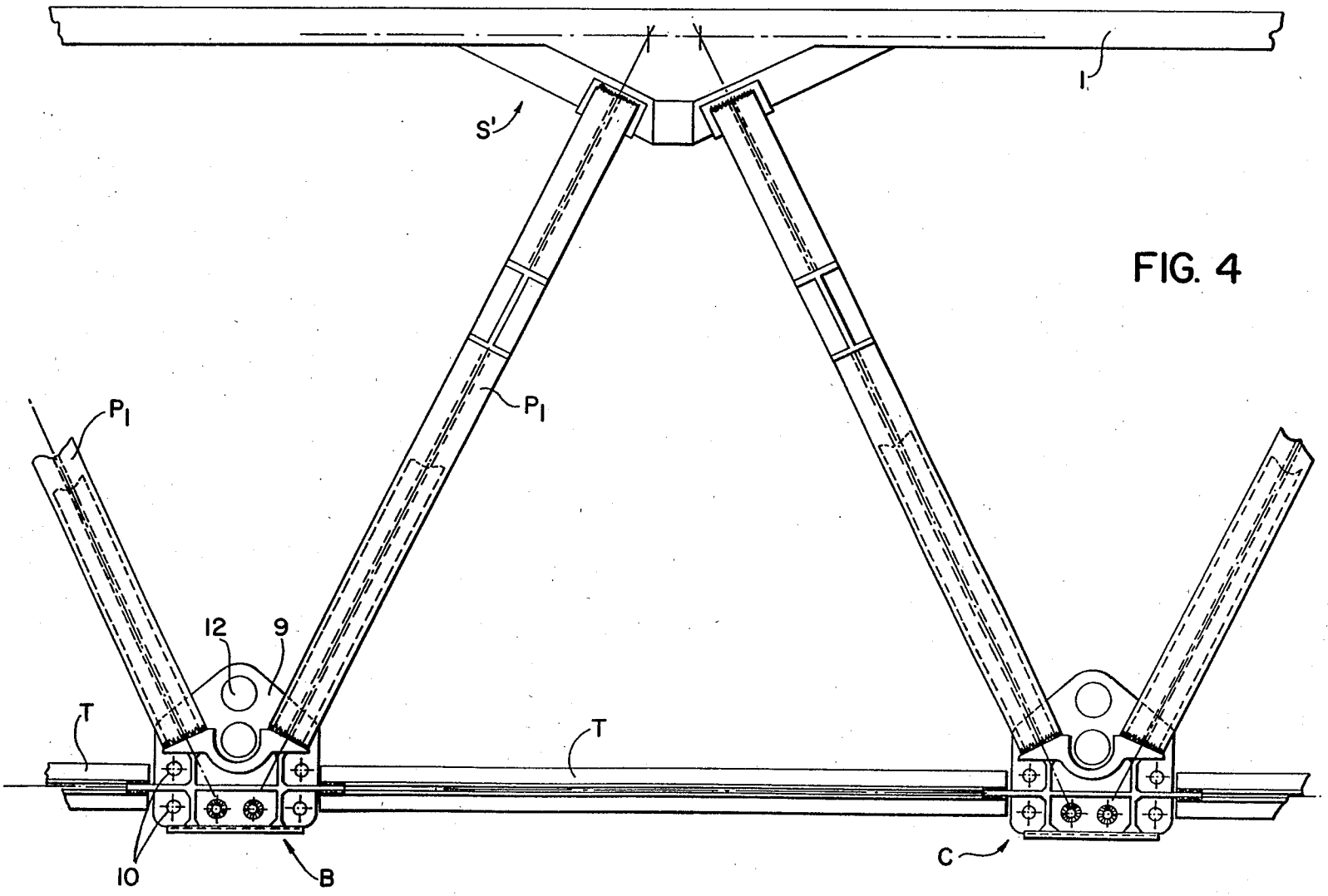
FIG. 4 is a fraction of a view of the arch stone in a transverse vertical plane, showing two connection pieces of the frame and the oblique sections of the vertical plane which terminate at these pieces.
Figure 5:
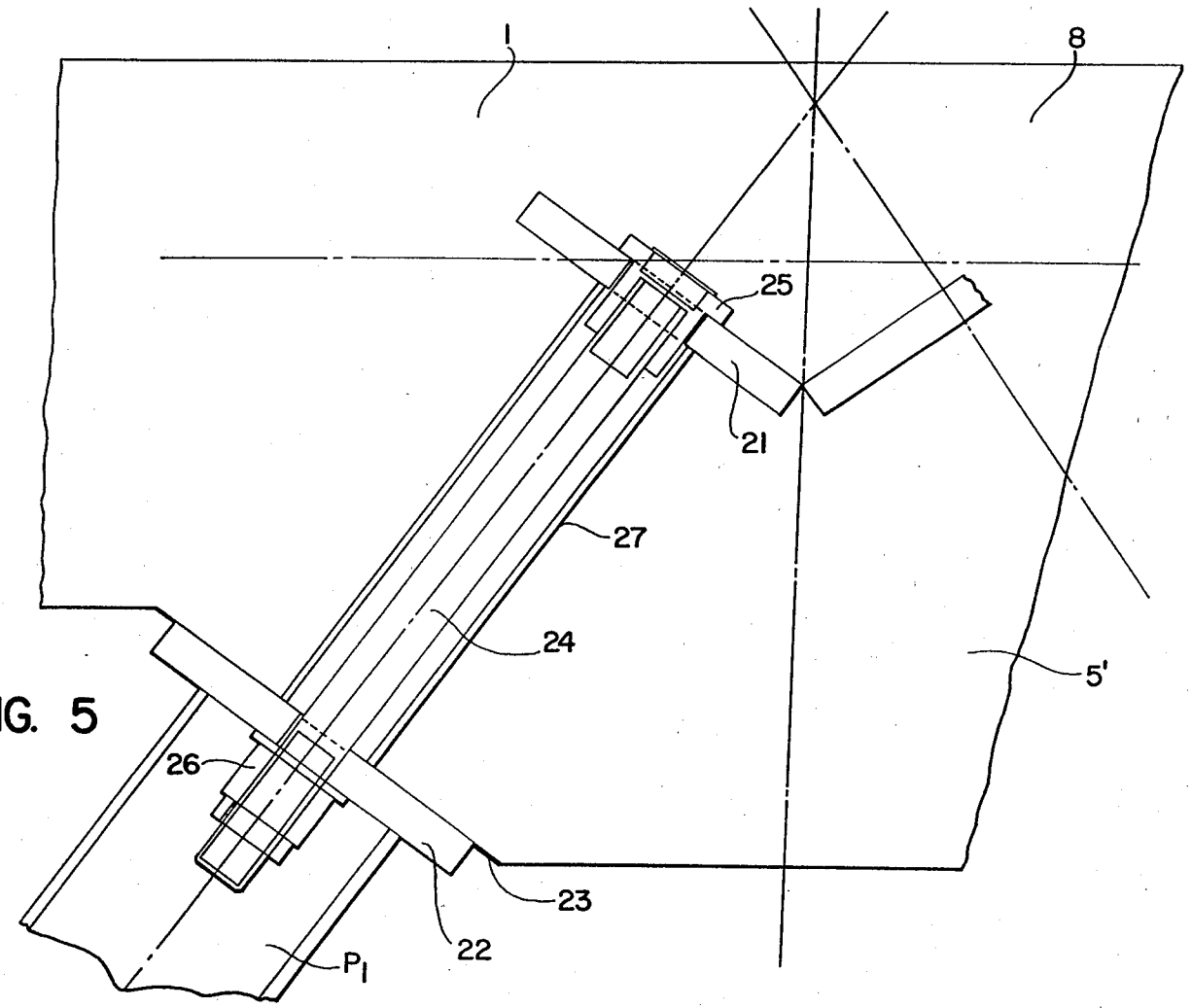
FIG. 5 is a diagram of an apparatus for attaching an oblique section of the metal frame to the upper slab of the arch stone.

In one example, this device comprises (FIGS. 1, 4 and 5) a plate 21 located in the zone $S^1$ of the concrete of the upper slab 1, and a plate 22 located outside this concrete, welded to the upper end of an oblique H-shaped section and resting flat against an oblique surface 23 formed on the under-face of the concrete slab 1, these two plates being penetrated by a threaded rod 24 held by screws 25 and 26 on both sides of the plates 21 and 22, one of the screws being located inside the concrete, while the other screw is outside the concrete and is accessible from the botom of the concrete.

The threaded rods with said screws form high resistance bolts.

A metallic sheath 27 is attached by welding to the upper plate 21 to isolate the rod 24 form the concrete of the upper slab while the concrete is being cast.

The present invention is obviously not restricted to the production means which have merely been described by way of example.

Figure 6:
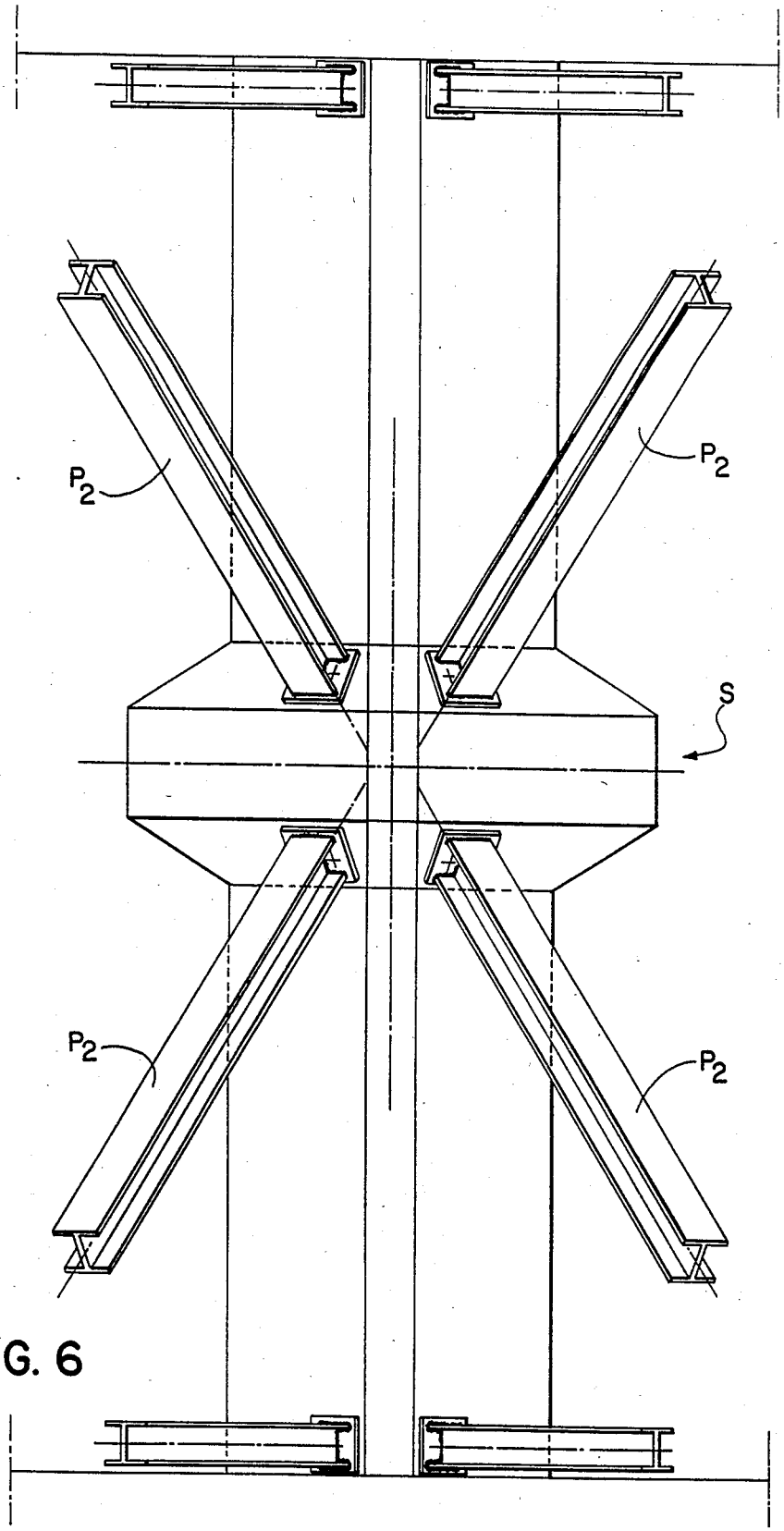
FIG. 6 is a bottom view of the concrete slab of the arch stone in the region where oblique sections of the metal frame terminate.

Similar means are used for attaching the H-shaped oblique sections $P_2$ to the median zones S of the underface of the concrete slab (FIGS. 1 and 6).

The concrete arch stones do not comprise the metal frame of the mixed arch stones, but they comprise means for positioning and fixing the mixed arch stones adjacent to the concrete arch stones. These means are, for example, bolt rods or adequate plates attached to the concrete arch stones to guide and receive for attachment the adjacent connection pieces of the metal frames of the mixed arch stones. On the other hand, the concrete arch stones comprise means for anchoring the ends of the prestress cables which penetrate the frames of the mixed arch stones.

Figure 7:
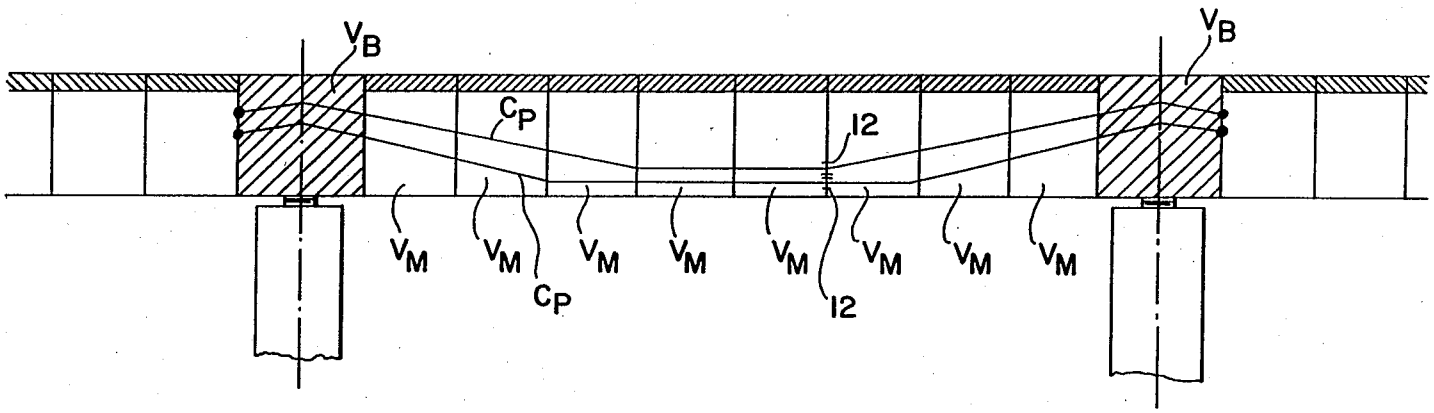
FIG. 7 is a diagram of a bay of a bridge comprising an arch stone according to the present invention.

A construction consisting of a floor or a similar structure according to the present invention rests on supports which are usually situated right under the concrete arch stones, and FIG. 7 is a diagram of a bay of a bridge according to the present invention. For this example, it has been assumed that this bay comprises eight mixed arch stones $V_m$ between two concrete arch stones $V_B$, the assembly being reinforced by prestress cables $C_p$ anchored in the concrete arch stones and passing into perforations 12 in the transverse plates of the assembly parts.

Figure 8:
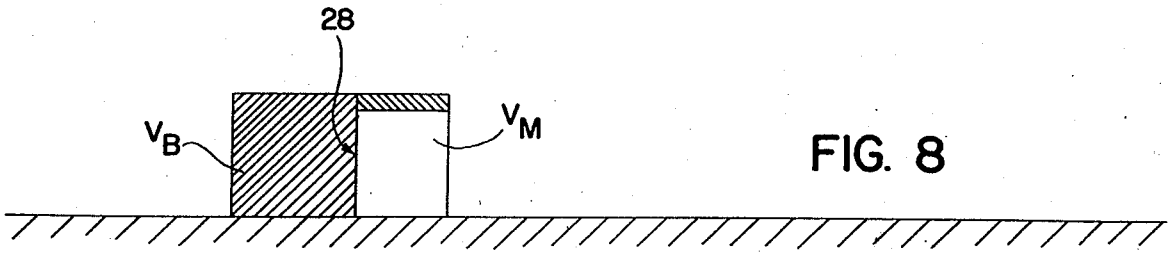
FIG. 8 is a diagram relating to the method of constructing a bridge bay.

In order to produce a running bay of such a construction, it is possible, according to the present invention, to apply a method which comprises (FIG. 8), on a prefabrication bed or other flat surface, the construction of one of the concrete arch stones $V_B$ of the bay; the construction of the adjacent mixed arch stone $V_M$ of the bay away from the adjacent surface 28 of the concrete arch stone in order to perfectly join the concrete of the upper slab of the concrete arch stone and the upper slab of this mixed arch stone; the construction of each of the other mixed arch stones of the bay by proceeding each time away in end-to-end relationships from the lateral adjacent surface of a mixed arch stone which has already been constructed to construct the following mixed arch stone in order to perfectly join the upper slabs and the metal frames of the adjacent mixed arch stones; the construction of the second concrete arch stone of the bay away from the last mixed arch stone of the bay in order to perfectly join the concrete slab of the last mixed arch stone and the concrete slab of the second concrete arch stone; the individual transport of the prefabricated arch stones into their service position in the bay; and the assembly of the mixed arch stones and of the two concrete arch stones between which the mixed arch stones are positioned by prestress cables penetrating the metal frames of the mixed arch stones and anchored at their ends in the concrete arch stones.

The present invention is not restricted to the embodiments which have been described, and a departure is not made from this invention by replacing the technical means which have been described by equivalent means. For example, provision is made to replace, if desired, the single sections by double sections, notably to divide the longitudinal sections into two, which makes it possible to modify the location of the holes for the passage of the longitudinal prestress cables.

I claim:

1. A floor of a bridge or a similar structure, which is constructed from sections which are assembled step by step, the floor comprising a series of longitudinally extending mixed steel-concrete sections, each comprising an upper concrete slab and a metal frame of steel integral with and disposed between and supporting the upper concrete slab, said series of mixed sections being arranged in end-to-end abutting relationship, a concrete anchor section at each end of each such series of mixed sections, each concrete section being supported from beneath as by a bridge pier, and a plurality of longitudinally extending prestress cables, the series assembly of the mixed and concrete sections being reinforced by the prestress cables which freely penetrate the metal frames and which are attached at opposite ends to the concrete sections, each mixed section having prefabricated connection pieces lying in a lower substantially horizontal plane, and diagonal frame members extending upwardly therefrom and connecting to and supporting the upper concrete slab, and at least some of the connection pieces having a transverse front plate to be fitted against a similar plate of a corresponding surface of an adjacent mixed section and said connection pieces having holes for the free passage of said prestress cables.

2. A bridge floor according to claim 1, wherein positioning means are provided and comprise pin/bore couplings, the pin of one plate penetrating the bore of the adjacent plate and absorbing the shearing stresses.

3. A bridge floor according to claim 1, wherein the connection pieces have inclined surfaces, against which the ends of some of the frame members and positioned along diagonal lines abut perpendicularly and are welded.

4. A bridge floor according to claim 1 wherein connection pieces have horizontal surfaces, between which are positioned the ends of the frame members arranged along the longitudinal lines and to which these ends are welded.

5. A bridge floor according to claim 4 wherein the connection pieces are cast.

6. A bridge floor according to claim 5 wherein at least some of the connection pieces comprise a vertical front plate and, on the back of this plate, a lower horizontal plate and an upper horizontal plate which has two cuneiform wings.

7. A bridge floor according to claim 6 wherein frame members arranged along the longitudinal lines are H-shaped, and the frame members arranged along transverse lines are welded to the flanges of the H-shaped members in the region of the connection pieces.

8. A bridge floor according to claim 7 wherein the members arranged along the transverse lines comprise two angle irons welded to a flat part positioned between the angle irons and itself welded to the H-shaped member.

9. A bridge floor according to claim 1 wherein each member positioned along a diagonal line is attached to the concrete slab by detachable means so that the member can be disconnected from the slab.

10. A bridge floor according to claim 9 wherein said detachable means comprises upper and lower metal plates connected by threaded rods, the upper plate being located in the concrete of the upper slab and the lower plate being located outside the concrete of the slab and integral with the member, said lower plate being attached to the rods by screws which are accessible from the bottom of the slab.

11. A bridge floor according to claim 10, wherein said threaded rods form with said screws resistance bolts.

12. A bridge floor according to claim 10 wherein metal sheaths attached by welding to the upper plate isolate said rods from the concrete.

13. A bridge floor according to claim 9 wherein the upper ends of oblique frame members are provided with bearing plates which are welded thereto and which rest flat against oblique surfaces of the under-face of the upper concrete slab.

* * * * *

UNITED STATES PATENT AND TRADEMARK OFFICE

CERTIFICATE OF CORRECTION

PATENT NO. : 4,589,157

DATED : May 20, 1986

INVENTOR(S) : Pierre Richard

It is certified that error appears in the above-identified patent and that said Letters Patent are hereby corrected as shown below:

Cover Page, Item [30] Foreign Application Priority Date

"Jan. 24, 1983 [FR] France 8201439" should be --Jan. 29, 1982 [FR] France 8201439--.

Signed and Sealed this

Fourth Day of November, 1986

[SEAL]

*Attest:*

DONALD J. QUIGG

*Attesting Officer*

*Commissioner of Patents and Trademarks*